US005957342A

United States Patent [19]

Gallien

[11] Patent Number: 5,957,342

[45] Date of Patent: Sep. 28, 1999

[54] MOUNTING CUP AND VALVE ASSEMBLY FOR PRESSURIZED CANISTER

[75] Inventor: Walter Richard Gallien, Raymond, N.H.

[73] Assignee: Summit Packaging Systems, Inc., Manchester, N.H.

[21] Appl. No.: 09/150,281

[22] Filed: Sep. 9, 1998

[51] Int. Cl.[6] ..... B65D 83/14

[52] U.S. Cl. ..... 222/402.22

[58] Field of Search ..... 222/394, 402.1, 222/402.21, 402.22, 402.24; 251/303, 350, 353, 354

[56] References Cited

U.S. PATENT DOCUMENTS

| | | | |
|---|---|---|---|
| 2,582,262 | 1/1952 | Loven et al. | 222/402.23 X |
| 2,777,735 | 1/1957 | Green | 222/402.24 |
| 2,837,375 | 6/1958 | Efford et al. | 222/402.25 X |
| 3,033,425 | 5/1962 | Gawthorp | 222/402.24 X |
| 3,060,965 | 10/1962 | Taggart | 222/402.22 X |
| 3,095,127 | 6/1963 | Green | 222/402.24 |
| 3,344,961 | 10/1967 | Graham | 222/402.22 |
| 3,348,743 | 10/1967 | Green | 222/402.24 |
| 3,371,825 | 3/1968 | Cullen | 222/402.24 X |
| 3,416,770 | 12/1968 | Green | 222/402.22 X |
| 3,434,633 | 3/1969 | Green | 222/402.22 X |
| 3,506,165 | 4/1970 | Beard | 222/402.22 |
| 3,572,557 | 3/1971 | Montgomery et al. | 222/402.22 |
| 3,901,410 | 8/1975 | Schultz | 222/402.22 X |
| 3,920,165 | 11/1975 | Schultz | 222/402.23 |
| 3,926,349 | 12/1975 | Schultz | 222/402.22 |
| 4,019,687 | 4/1977 | Green | 222/402.24 X |
| 5,533,755 | 7/1996 | Bonewald et al. | 222/402.21 |

*Primary Examiner*—Kevin P. Shaver
*Attorney, Agent, or Firm*—Davis and Bujold

[57] ABSTRACT

A valve assembly and mounting cup combination which comprises a mounting cup having an exterior, outwardly facing surface and an interior, inwardly facing surface, and a perimeter curl for attaching the mounting cup to a desired rim of a container. The mounting cup includes a pedestal portion with a conically-shaped top surface having a centrally located aperture formed therein and a gasket is disposed within the pedestal portion between an undersurface of the pedestal portion and a valve assembly. The valve assembly comprises a valve body, a valve stem with a base, and a spring. The assembly is disposed in and retained by the pedestal portion, via a conventional crimping process, with a product outlet carried by the valve stem and protruding through the aperture in the gasket and the central aperture. The spring biases the valve base against the gasket to form a seal therebetween. The conical shape of the top wall of the pedestal portion provides an enhanced clearance between and undersurface of the gasket and an adjacent surface of the base. This enhanced clearance allows the radial orifices, carried by the valve stem, to be located therebetween and have relatively large diameters. This, in turn, facilitates forming of the radial orifices in the valve stem during the initial molding process, instead of during a subsequent manufacturing step.

20 Claims, 4 Drawing Sheets

MOUNTING CUP AND VALVE ASSEMBLY FOR PRESSURIZED CANISTER

FIELD OF THE INVENTION

This invention relates to pressurized spray containers or canisters in general and, more particularly, to an improved mounting cup and valve assembly arrangement for such pressurized spray canisters.

BACKGROUND OF THE INVENTION

Pressurized spray canisters have long been utilized as economical, convenient, and portable storing and dispensing devices, accommodating products as diverse as paint, insecticide, whipped cream, etc. Because of the pressurized spray canister's wide spread popularity and applicability, millions and millions of units are manufactured each year throughout the world. Improvements in the design and manufacturing processes are constantly sought after by the spray canister industry, since even a very minor cost reduction per unit, given even one manufacturer's production volume, can quickly accumulate into large production savings.

Pressurized spray canisters typically have a cylindrical metal container or canister sealed by a mounting cup and valve assembly combination. Alternatively, a metal pressure dome may seal the a wider open end of the canister, with the mounting cup and valve assembly, in turn, being sealingly engaged with a central opening of the pressure dome. This causes a valve stem and spray button portion of the valve assembly to be disposed a greater distance away from a top surface of the canister, which facilitates more accurate and easy product dispensing.

Two types of valve assemblies are typically provided with pressurized spray canisters. One is a vertical depression-valve assembly, where product is dispensed when the valve stem is vertically depressed along the vertical axis of the valve. The other is a tilt-valve assembly, where product is dispensed when the valve stem is sufficiently tilted from the vertical axis of the valve. The former is most often used in conjunction with right-angle spray buttons and actuators for spraying product radially with respect to the canister, and the later is most often used with spray-through spray buttons and actuators for providing off-axis dispensing.

Spray canister mounting cups, for use with tilt-valve assemblies for example, typically have an exterior, outwardly facing surface and an interior, inwardly facing surface, a perimeter curl for attaching or securing the mounting cup to the rim of the canister or dome, and a centrally located aperture surrounded by a generally flat-top surface of the pedestal portion. The pedestal portion serves to partially house the valve assembly and also assists with positioning the valve stem and spray button a small distance away from the top of the canister.

Known tilt-valve assemblies have a washer-shaped gasket disposed within the interior of the pedestal portion, about the centrally located aperture, to form a first portion of a seal. An internal area of a valve body supports a compression spring, which biases a base of the valve stem against the gasket to form the second component of the seal and achieve an adequate seal between the interior of the canister and the exterior environment. The valve stem has a product outlet which communications with at least one and preferably a plurality of radially extending orifices that are located just below the gasket but above the base of the valve stem.

During use, once the valve stem is sufficiently tilted, e.g. causing one side portion of the valve stem base to "bite into the gasket" while the opposite side portion of the valve stem base to be sufficiently lifted away from the gasket, the flow of the product to be dispensed from the canister is allowed through the valve. The product to be dispensed then communicates with the one or more radial orifices and flows vertically upward, along the passageway in the valve stem, and out through a discharge outlet of a spray button or actuator, in a conventional fashion.

Turning now to FIG. 1, a brief description concerning one prior art mounting cup and tilt-valve assembly arrangement will be provided. As can be seen in this figure, the valve assembly is accommodated within the pedestal portion 28 of the mounting cup 10 in a conventional manner. By this arrangement, the gasket 32 and the top wall 30 of the pedestal portion 28 are both substantially planar and extend substantially parallel to one another. Due to this arrangement, the circumferential sealing protrusion 60 which engages with the gasket 32 is much more pronounced and forms a fairly deep annular well 55 between the circumferential sealing protrusion 60 and the central region of the valve stem 52. This arrangement leads to a more complicated valve stem 52 in which the radial orifices 64 can not be readily molded in the valve stem during a single manufacturing step, e.g. a subsequent manufacturing step is required to form the radial orifice or radial orifices 64.

The disadvantage of the above referenced prior art design is that the radial orifice or orifices generally have a relatively small diameter in order to be located between the base of the valve stem and an adjacent undersurface surface of the gasket. This is because there is only a very small clearance or area between the undersurface surface of the gasket and the adjacent top surface of the valve stem base. With a planar gasket, it is extremely difficult to provide both a proper seal between the valve stem base and gasket and a sufficient clearance for relatively large radial orifices.

Such tiny radial orifices are often only pin-hole sized, having a diameter of around 0.013 inches or so. Because of the required position of the holes, it is extremely difficult to accurately form the holes in the valve stem, especially during commercial production, as part of the initial molding process, and a further orifice forming step is required. Thus, not only must an extra manufacturing step be carried out for each valve stem, but the orifice forming equipment is expensive to purchase, maintain and operate and, because the radial orifices must be accurately positioned, sometimes the orifice forming equipment requires adjustment. Such expenses and/or adjustment delays can greatly slow down production speed and increase production costs.

Also, as the pin-hole sized radial orifices provide a minimal cross-sectional product flow path, the ability to supply the product to be dispensed, via a conventional through-the-valve-stem charging process, is also somewhat hindered.

Furthermore, although it is theoretically possible to provide larger diameter radial orifices 64 in the valve stem 52 (for example, dimensioned to be the same size as the well 55), such radial orifices would still have to be accurately placed and formed via at least one additional manufacturing step.

SUMMARY OF THE INVENTION

Wherefore, it is an object of the present invention to overcome the aforementioned problems and drawbacks associated with the prior art designs.

Another object of the invention is to provide a tilt-valve assembly and mounting cup combination wherein a plurality of radial orifices are provided in the valve stem with the radial orifices having somewhat large diameters and being spaced further away from a valve stem base than those in the prior art.

Another object of the present invention is to provide a tilt-valve assembly and mounting cup combination wherein both the valve stem and radial orifices are manufacturable in during a single manufacturing step, e.g. during the initial molding step of the valve stem.

Yet another object of the present invention is to provide a tilt-valve assembly and mounting cup combination wherein the valve stem base is thicker and sturdier than the valve stem base of the prior art designs and has a shallower depth well between a circumferential sealing protrusion and a cylindrical portion of the valve stem.

Another object of the tilt-valve assembly and mounting cup combination of the present invention is to provide an enhanced pressurized seal between the valve stem base and a gasket.

The tilt-valve assembly and mounting cup combination, of the present invention, comprises a mounting cup having an exterior, outwardly facing surface and an interior, inwardly facing surface, a perimeter curl for attaching the mounting cup to a canister rim, and a pedestal portion supporting a centrally located aperture. The pedestal portion has a conically-shaped top wall and a substantially vertical side wall. A flat, or possibly conically-shaped, gasket with a central aperture is disposed within the pedestal portion, against an inwardly facing surface of the top wall, for sealing engagement with the valve assembly.

The valve assembly, typically a tilt-valve assembly, comprises a valve body housing a valve stem with a base, and a spring arrangement for biasing the base of the valve stem against gasket. The valve assembly is disposed within and retained by the pedestal portion of the mounting cup, by a conventional crimping process. The valve assembly has a product inlet, at a lower portion thereof, which communicates with a product outlet, provided in the valve stem which protrudes through the gasket and aperture to facilitate the flow of product through the valve assembly. The base of the valve stem carries a perimeter sealing protrusion which is shaped to engage with a portion of the gasket, both radially and axially spaced from the central aperture. The spring arrangement, e.g. a compression spring, which is housed within the valve assembly, biases the perimeter sealing protrusion of the valve stem base against the gasket to provide a fluid seal therebetween. Such sealing engagement provides a circumferential seal as well as an enhanced clearance between a region of the gasket proximate the gasket's aperture and the transition of the cylindrical valve stem with the valve stem base. The enhanced clearance allows the plurality of radial orifices, disposed in the valve stem for providing a product outlet path, to have relatively larger diameters than those of the prior art.

The present invention relates to an improved mounting cup and valve assembly combination for an aerosol container, the combination comprising: a mounting cup having a perimeter curl, for securing the mounting cup to a desired container, and a pedestal portion with a centrally located aperture; a valve assembly having valve body with a product inlet communicating with an interior cavity of the valve body, a product outlet being formed in a valve stem being at least partially supported by the valve body, and at least one radial orifice being formed in the valve stem, adjacent a base portion of the valve stem, to provide communication with the product outlet; and the valve assembly being housed within the pedestal portion and being crimped thereto with a gasket being located between a perimeter sealing surface of the base portion and an adjacent inwardly facing surface of the pedestal portion with a portion of the valve stem supporting the product outlet protruding through an aperture provided in the gasket and the centrally located aperture; wherein a top wall of the pedestal portion is conically shaped such that a first plane, defined by the perimeter engagement between the gasket and the base portion of the valve stem, is axially spaced from a second plane, defined by the perimeter engagement between the gasket and a central portion of the valve stem, to provide an axial spacing along the valve stem for accommodating the at least one radial orifice between the first and second planes.

The present invention also relates to a pressurized spray canister comprising: a mounting cup having a perimeter curl and a pedestal portion with a centrally located aperture; a valve assembly having valve body with a product inlet communicating with an interior cavity of the valve body, a product outlet being formed in a valve stem being at least partially supported by the valve body, and at least one radial orifice being formed in the valve stem, adjacent a base portion of the valve stem, to provide communication with the product outlet; and the valve assembly being housed within the pedestal portion and being crimped thereto with a gasket being located between a perimeter sealing surface of the base portion and an adjacent inwardly facing surface of the pedestal portion with a portion of the valve stem supporting the product outlet protruding through an aperture provided in the gasket and the centrally located aperture; the spray canister being closed at one end and having an opening being defined by a rim at an opposite end thereof; the perimeter curl of the mounting cup being connected to the rim of the canister to permanently support the valve assembly within the canister; and a spray button, with a discharge orifice, being coupled to the product outlet of the valve stem to facilitate dispensing of the product from the pressurized spray canister; wherein a top wall of the pedestal portion is conically shaped such that a first plane, defined by the perimeter engagement between the gasket and the base portion of the valve stem, is axially spaced from a second plane, defined by the perimeter engagement between the gasket and a central portion of the valve stem, to provide an axial spacing along the valve stem for accommodating the at least one radial orifice between the first and second planes.

The present invention finally relates to a method of forming an improved mounting cup and valve assembly combination for an aerosol container, the method comprising the steps of: providing a mounting cup with a perimeter curl, for securing the mounting cup to a desired container, and a central pedestal portion with a centrally located aperture being formed in the pedestal portion; providing a valve assembly with valve body having a product inlet communicating with an interior cavity of the valve body, and a product outlet being formed in a valve stem being at least partially supported by the valve body, and forming at least one radial orifice in the valve stem, adjacent a base portion of the valve stem, to provide communication with the product outlet; and housing the valve assembly within the pedestal portion and crimping the valve assembly therein with a gasket being located between a perimeter sealing surface of the base portion and an adjacent inwardly facing surface of the pedestal portion with a portion of the valve stem, supporting the product outlet, protruding through an aperture provided in the gasket and the centrally located aperture; contouring a top wall of the pedestal portion to have a conical shaped such that a first plane, defined by the perimeter engagement between the gasket and the base portion of the valve stem, is axially spaced along the valve stem from a second plane, defined by the perimeter engagement between the gasket and a central portion of the valve stem, with the at least one radial orifice being formed in the valve stem at a location between the first plane and the second plane.

BRIEF DESCRIPTION OF THE DRAWINGS

The invention will now be described, by way of example, with reference to the accompanying drawings in which.

DESCRIPTION OF THE PREFERRED EMBODIMENTS

Figure 2:
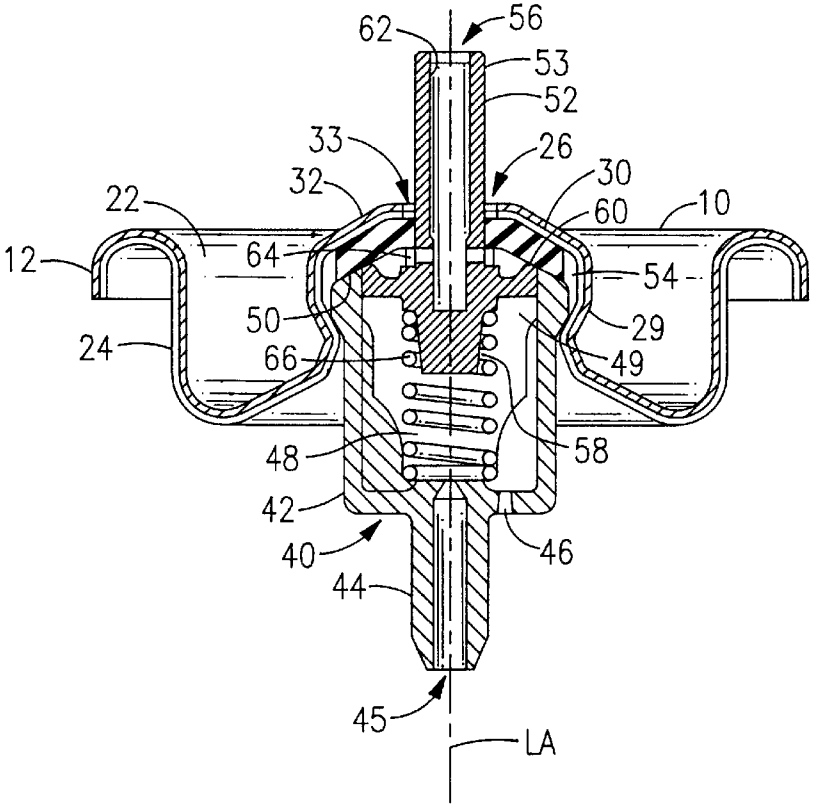
FIG. 2 is a diagrammatic cross-sectional view of a mounting cup and tilt-valve assembly combination, according to the present invention, shown prior to attachment with an actuator or a spray canister.

Turning now to FIGS. 2–5, a detailed description concerning the present invention will now be provided. As seen in FIG. 2, as with conventional prior art designs, the mounting cup 10 is provided with a perimeter curl 12 for attaching the mounting cup 10 to a rim of a desired pressurizable container or canister 16, or to a rim 18 of a dome 20 (see FIG. 6) which is, in turn, attached to a pressurizable container or canister 16. The mounting cup 10 has an outwardly facing surface 22 and an inwardly facing surface 24. A central aperture 26 is provided in mounting cup 10, in the region of a pedestal portion 28, for accommodating a valve stem. The pedestal portion 28 has a generally vertical cylindrical side wall 29, prior to crimping, and an integrally formed conically shaped top wall 30. An angle ($\alpha$), formed between a horizontal plane HP extending through a central portion of the mounting cup 10 and the top wall 30 (FIG. 4), is generally between about 10 to 45 degrees, more preferably about 20 to 30 degrees, and most preferably about 25 degrees.

A flat, or possibly a conically-shaped, gasket 32 is disposed on the inwardly facing surface 24 of the top wall 30 of the pedestal portion 28. The gasket 32 has an aperture 33 which is slightly smaller in size than the aperture 26 provided in the pedestal portion 28, to provide a snug seal with respect to the cylindrical exterior surface of a valve stem 52. During use, the aperture 33 of the gasket 32 is aligned with the aperture 26 provided in the pedestal portion 28.

A valve assembly 40 includes a valve body 42 which, in part, is a generally cylindrical, longitudinally hollow member which is open at a top end thereof. The open end of the valve body 42 accommodates the valve stem 52 while and the opposite base end of the valve body 42 is provided with a cylindrical dip tube coupling 44 which has an inlet passage 45 formed therein which communicates with the interior cavity 49 of the valve body 42. The base end of the valve body 42, supporting the dip tube coupling 44, is also has a vapor inlet or tap 46 formed therein. The vapor inlet or tap 46 allows a small amount of pressurized fluid, i.e. propellant contained within the canister, to mix in the central interior cavity 49 of the valve body with the product being conveyed through the dip tube coupling 44, to provide a more uniformly dispensed product. As such a vapor tap and mixing feature is well known in this art, a further detailed description of the same is not provided.

The central interior cavity 49 of the valve body 42 defines a spring support area 48 which is provided with a plurality of conventional spring guide members. A compression spring 66 is accommodated within the spring support area 48 for biasing a base 54 of the valve stem 52 into engagement with an undersurface of the gasket 32, and a further discussion concerning the same will follow below. The inlet passage 45 and the vapor inlet or tap 46 both facilitate communication of the product to be dispensed with the central interior cavity 49 of the valve body 42.

A first end of a dip tube 70 is connected, in a conventional manner, to the dip tube coupling 44 while a second remote end of dip tube 70 is positioned, during use, adjacent the bottom area of the canister 16 to communicate with the liquid product to be dispensed (FIG. 6) and facilitate conveying of the product to be dispensed from the bottom of the canister 16 to the valve.

The open end of the valve body is defined by a perimeter, circumferential angled rim 50 dimensioned to engage with and form a fluid tight seal with a perimeter area of the gasket 32. The open end of the valve assembly 40 accommodates the valve stem 52 which includes a generally elongate cylindrical body 53 extending from a generally planar valve stem base 54. A product outlet 56 is formed at the opposite end of the generally elongate cylindrical body 53 of the valve stem 52. A lower or bottom portion of the valve stem 52, opposite to the generally elongate cylindrical body 53, supports an integral spring engagement nub 58 which engages with and supports the spring 66.

Figure 5:
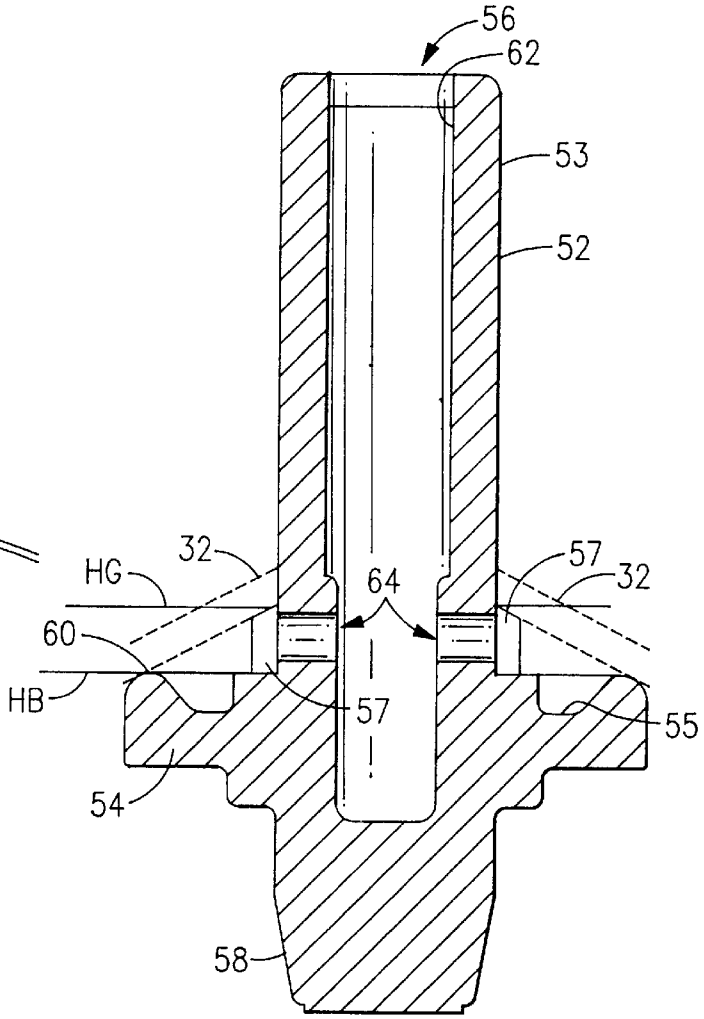
FIG. 5 is a diagrammatic cross-sectional view of the improved valve stem, according to the present invention.
Figure 1:
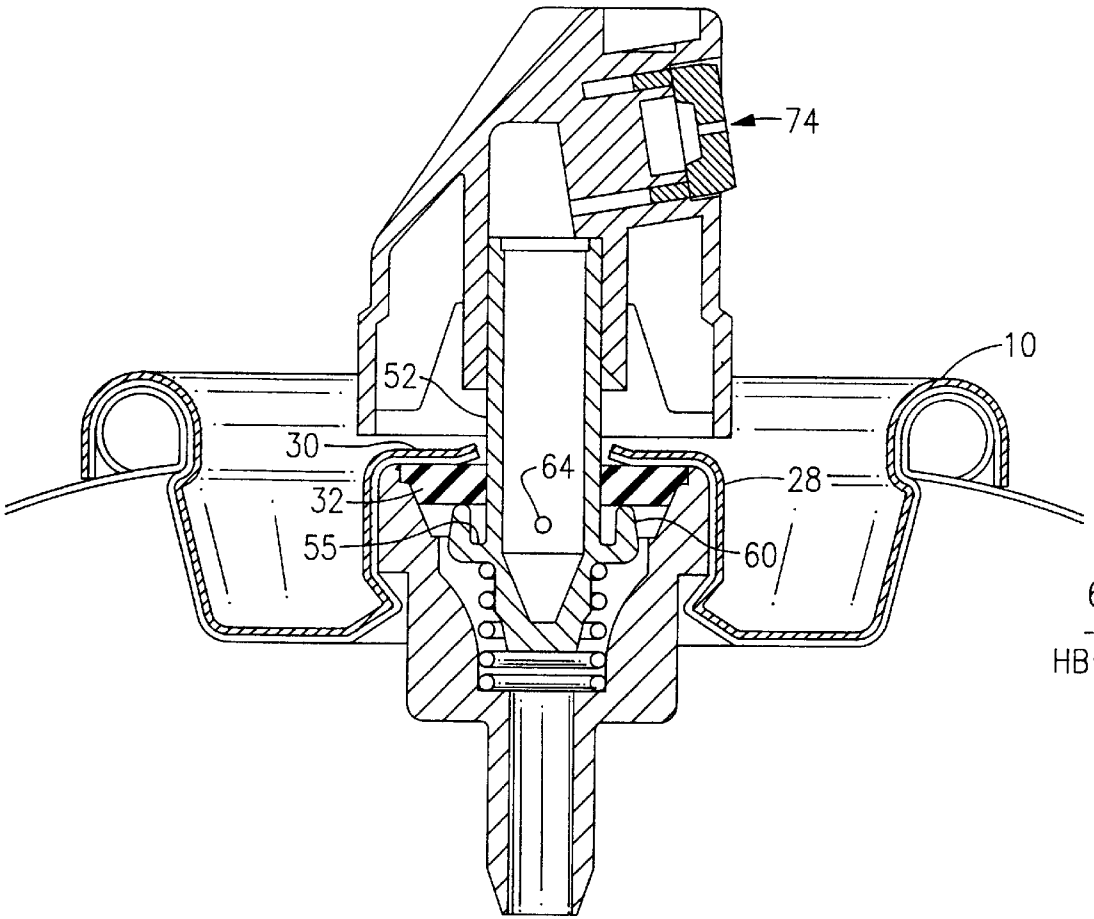
FIG.1 Prior Art
FIG. 1 is a diagrammatic cross-sectional view of a prior art mounting cup and tilt-valve assembly combination shown attached to an opening of a spray canister.
Figure 3:
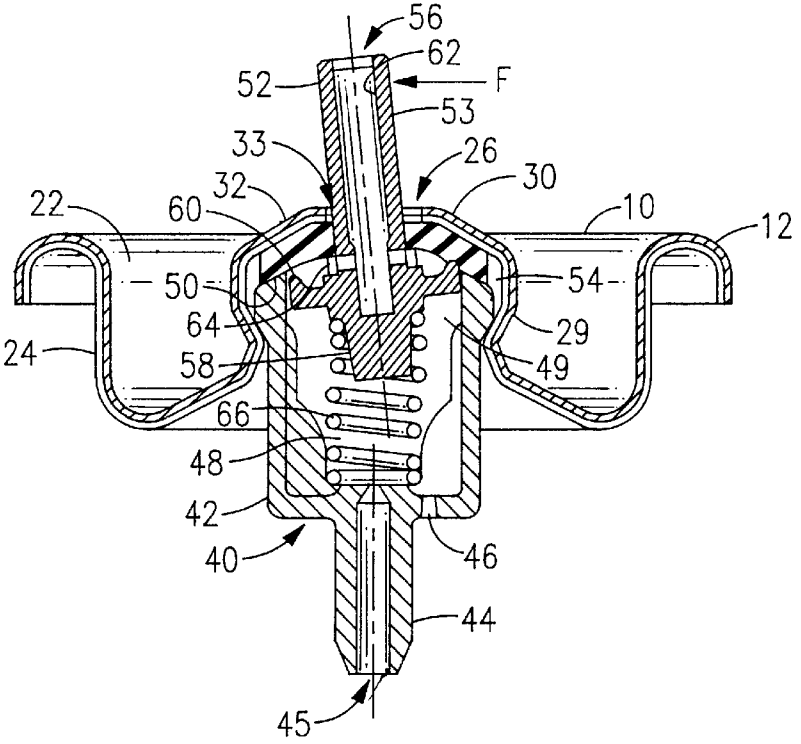
FIG. 3 is a diagrammatic cross-sectional view of the mounting cup and tilt-valve assembly combination, of FIG. 2, showing the tilt-valve in a partially actuated position.

A perimeter, circumferential sealing protrusion 60 is carried by the valve stem base 54 at a location radially spaced from the generally elongate cylindrical body 53 and facing the gasket 32. A longitudinal through-bore or outlet product passage 62 extends through the generally elongate cylindrical body 53 from adjacent the valve stem base 54 to the product outlet 56. At least one and possibly a plurality of radial extending orifices 64, two of which are seen in FIGS. 2, 3 and 5, extend through the elongate cylindrical body 53 at a location proximate to but spaced from the valve stem base 54 to provide a product flow path to the product passage 62 provided in the generally elongate cylindrical body 53. The valve assembly 40 and the valve stem 52 together define a longitudinal axis LA (FIG. 2) of the valve assembly.

During assembly, the spring 66 is located on and supported by the nub 58 while the gasket 32 is received by the elongate cylindrical body 53 of the valve stem 52 and slid to a position adjacent the valve stem base 54. Thereafter, the valve assembly is placed within the open end of the valve body 42 such that the spring 66 is received by the spring support area 48 of the valve body 42. Next, the gasket/valve-stem/spring/valve-body assembly is received within the pedestal portion 28 such that the elongate cylindrical body 53 of the valve stem 52 extends through the aperture 26 in the pedestal portion 28 and the gasket 32 abuts against the undersurface of the top wall 30 of the pedestal portion 28. With the components maintained in this relationship, the valve assembly 40 is crimped to the pedestal portion 28 of the mounting cup 10 to permanently retain the valve assembly 40 within the pedestal portion 28 of the mounting cup 10. Once the crimping process is completed, the compression spring 66 is sufficiently compressed and the expansion force of the compression spring 66 is sufficient to bias the sealing protrusion 60 against the gasket 32 to provide the desired seal.

As seen in FIG. 2, the sealing protrusion 60 is approximately aligned horizontally with the top portion of the angled rim 50 but maintained in sealing engagement with the underside of the gasket 32, via the biasing force of the spring 66. The valve assembly 40 shown in FIG. 2 is in its sealed, unactuated state.

With reference to FIG. 5, the top surface of the sealing protrusion 60, which engages with the gasket 32, defines a first horizontal plane HB. The radial orifice(s) 64 are located above this first horizontal plane HB but below a second horizontal plane HG defined by the engagement between the lower perimeter portion of the gasket 32 (shown in dashed lines) and the elongate cylindrical body 53 of the valve stem 52. As can be seen in this figure, an integral annular shoulder 57 is supported by the of the valve stem 52 to ensure that the gasket 32 does not cover or blocked the radial orifice(s) 64 so that the radial orifice(s) 64 remains in continuous communication with the well 55. This shoulder 57 also provides an additional surface area for an enhanced sealing engagement with the gasket 32.

According to the prior art designs, the radial orifices 64 are generally located below the horizontal plane defined by the engagement between a top surface of the circumferential sealing protrusion with the undersurface of the gasket. Due to the arrangement of the present invention, a smaller and/or shallower depth well 55 may be formed in the base of the valve stem and this shallower depth well 55 still facilitates adequate distribution of the product to be dispensed from the internal cavity 49 of the valve body 42 to the radial orifice(s) 64 provided in the valve stem 52.

According to the arrangement of the present invention, the well depth is approximately 0.013 inches deep or so, e.g. the well may be substantially the same size or somewhat less than the transverse dimension of the radial orifice(s) 64. According to the relevant prior art designs, the prior art well depth is generally much deeper. By the stem arrangement of the present invention, it is easier to form the radial orifice(s) 64 of a relatively larger diameter, during the molding process of the valve stem, than was possible in the prior art designs. For example, the radial orifice diameters, according to the present invention, can have a diameter between about 0.013 to about 0.030 inches. It is to be appreciated that the desired diameter for the radial orifice(s) may vary from application to application and will generally depend on the product to be dispensed as well as the type of propellant utilized to dispense the product. As such teaching is well known in the art, further detail description concerning the same will not be provided.

An increased axial clearance or spacing is formed between the engagement between the top surface of the valve stem base 54 and undersurface of the gasket (i.e. first horizontal plane HB) and the engagement between the undersurface of the gasket 32 and the elongate cylindrical body 53 of the valve stem 52 (i.e. second horizontal plane HG), e.g. a clearance of between about 0.013 to 0.030 inches. This axial increased clearance or spacing allows the radial orifices 64 to have a relatively larger diameter than was possible in the prior art designs and be manufactured during production of the valve step, thereby eliminating the need for a further orifice forming step.

Although product to be dispensed has access to the interior cavity 49 of the valve body 42, via the dip tube coupling 44 and/or the vapor tap 46, the sealing engagement between the sealing protrusion 60 and the gasket 32 prevents the product to be dispensed from reaching the radial orifices 64 or the outlet product passage 62 until the valve stem 52 is sufficiently tilted or depressed.

Figure 4:
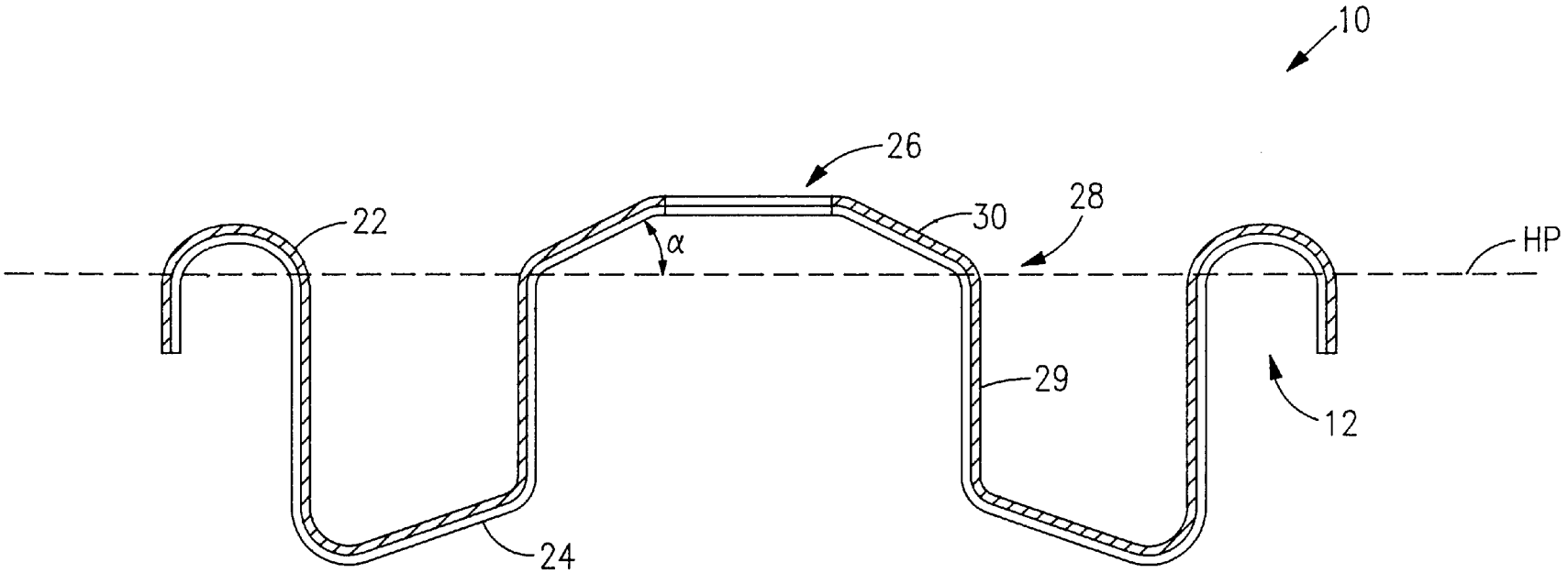
FIG. 4 is a diagrammatic cross-sectional view of the mounting cup of FIG. 2 before it is crimped.

As seen in FIG. 3, the valve assembly 40 is shown in its actuated state. If a tilting force F is applied to a remote end of the valve stem 52, such force, in turn, causes one side of the sealing protrusion 60 (i.e. the right side as seen in this figure) to bite slightly into the gasket 32 and maintain its sealing engagement with the gasket 32 due to the biasing force of the spring 66. However, the opposite side of the sealing protrusion 60 (i.e. the left side as seen in this figure) is tilted slightly away from the gasket 32, thereby creating a flow path from the interior cavity 49 of the valve body 42 to the product outlet 56, via the well 55, the radial orifices 64 and the outlet product passage 62. The pressurized product to be dispensed (e.g. paint, hair spray, oven spray, etc.) travels from the interior of the canister 16 up through the dip tube 70 and the dip tube coupling 44 into the interior cavity 49 of the valve body 42 (FIG. 4). In addition, propellant can enter the interior cavity 49 via the vapor tap 46 provided in the valve body 42. From there, once the valve assembly 40 is actuated, the uniformly mixed product travels over the sealing protrusion 60, i.e. between the sealing protrusion 60 and the gasket 32, and is distributed by the well 55 to the radial orifice(s) 64, conveyed along the outlet product passage 62 and out a discharge orifice 74 provided in an actuator.

Due to the relatively larger diameter of the radial orifices 64, the radial orifices 64 can typically be manufactured during initial production of the valve stem 52, i.e. there is no need to have a separate orifice forming step when producing the valve stem, and this refinement reduces the overall manufacturing costs associated with producing the valve stem. Accordingly, the valve stems can be injection molded and, as such a feature is well known to those skilled in this art, a further detailed description concerning the same is not provided herein.

Figure 6:
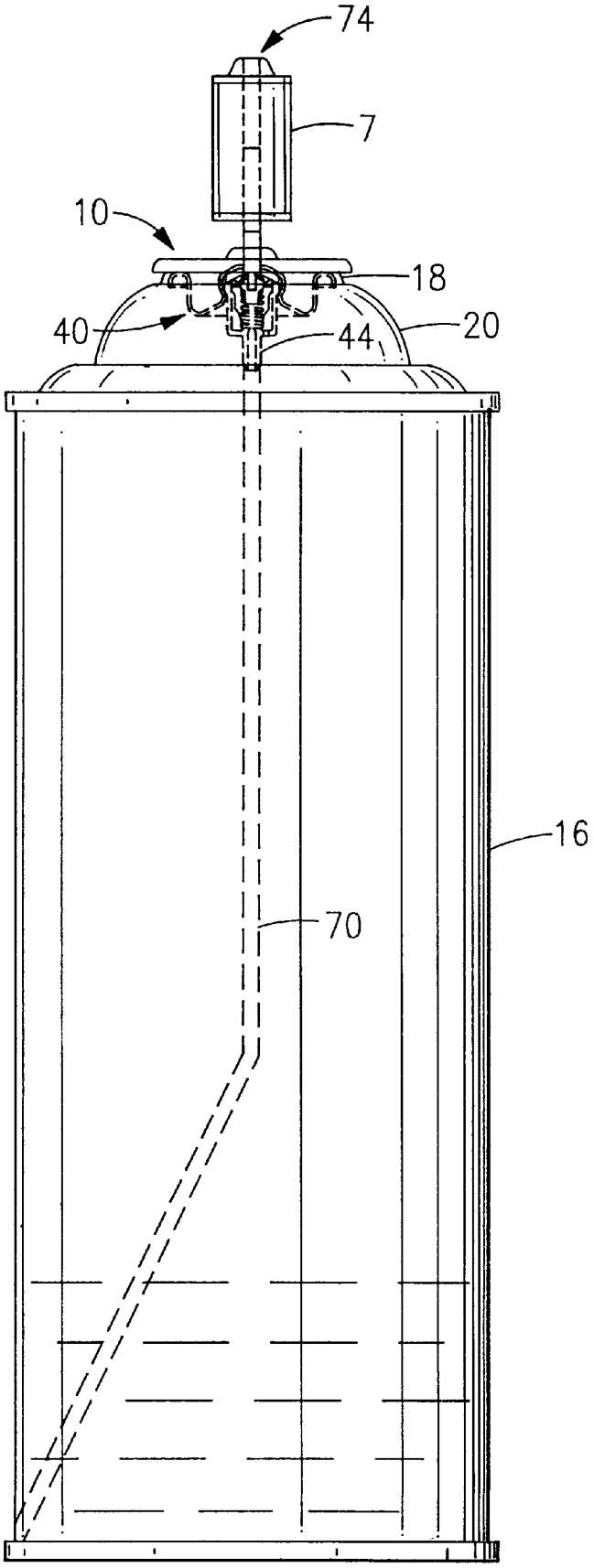
FIG. 6 is a diagrammatic front elevational view of the mounting cup and tilt-valve assembly combination, according to the present invention, shown attached to a spray canister carrying a spray button, with a portion of the internal components of the tilt-valve assembly shown in dashed lines.

With reference to FIG. 6, a typical arrangement of the mounting cup 10 and the valve assembly 40 when used with the canister 16 and a pressure dome 20 is seen. The dip tube 70 is friction fit over the dip tube receptacle 44 of the valve body 42 and extends down towards and communicates with a perimeter bottom area of the canister 16. A spray-through spray button or actuator 72, having an axial discharge outlet 74, e.g. a through-bore, is friction fit over the valve stem 52 such that a flow path is achieved between the product outlet 56 of the valve stem 52 and the discharge outlet 74.

Although the improved mounting cup and valve assembly combination of the present invention is illustrated for use with a tilt-valve, one of ordinary skill in the art will appreciate that such improved mounting cup and valve assembly combination could also be used with a vertical depression-valve assembly without departing from the spirit and scope of the invention.

Also, although the present invention is illustrated as having two radial orifices, one of ordinary skill in the art will appreciate that only one radial orifice or three or more radial orifices can be employed. In addition, the shape or orientation of the radial orifices can vary depending upon the particular application, without departing from the spirit and scope of the invention.

Since certain changes may be made in the above described mounting cup and valve assembly combination, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. An improved mounting cup and valve assembly combination for an aerosol container, the combination comprising:

a mounting cup having a perimeter curl, for securing the mounting cup to a desired container, and a pedestal portion with a centrally located aperture;

a valve assembly having valve body with a product inlet communicating with an interior cavity of the valve body, a product outlet being formed in a valve stem being at least partially supported by the valve body, and at least one radial orifice being formed in the valve stem, adjacent a base portion of the valve stem, to provide communication with the product outlet; and the valve assembly being housed within the pedestal portion and being crimped thereto with a gasket being located between a perimeter sealing surface of the base portion and an adjacent inwardly facing surface of the pedestal portion with a portion of the valve stem supporting the product outlet protruding through an aperture provided in the gasket and the centrally located aperture;

wherein a top wall of the pedestal portion is conically shaped such that a first plane, defined by the perimeter engagement between the gasket and the base portion of the valve stem, is axially spaced from a second plane, defined by the perimeter engagement between the gasket and a central portion of the valve stem, to provide an axial spacing along the valve stem for accommodating the at least one radial orifice between the first and second planes.

2. The improved combination according to claim 1, wherein the at least one radial orifice has a transverse dimension of approximately between 0.013 and 0.030 inches.

3. The improved combination according to claim 1, wherein the conically shaped top wall of the pedestal portion slopes, relative to a plane defined by the mounting cup, at an angle of about 25 degrees.

4. The improved combination according to claim 1, wherein a remote portion of the valve body includes a dip tube coupling, having a product inlet formed therein, which supports a first end of a dip tube that facilitates communication with product to be dispensed and the interior cavity of the valve body.

5. The improved combination according to claim 1, wherein a spring is located within the interior cavity of the valve body and normally biases the base portion of the valve stem into engagement with the gasket to provide a fluid tight seal therebetween and maintain the valve in a normally closed position.

6. The improved combination according to claim 5, wherein the base portion includes an annular perimeter sealing protrusion which forms the fluid tight seal with the gasket when engaged therewith under the biasing force of the spring.

7. The improved combination according to claim 1, wherein the base portion includes a nub, on a surface thereof remote from product outlet of the valve stem, which engages with a spring to bias the base of the valve stem into a normally closed position and prevent the flow of product to be dispensed through the at least one radial orifice and the product outlet.

8. The improved combination according to claim 1, wherein the axial spacing along the valve stem is a distance of between about 0.013 and 0.030 inches.

9. A pressurized spray canister comprising:

a mounting cup having a perimeter curl and a pedestal portion with a centrally located aperture;

a valve assembly having valve body with a product inlet communicating with an interior cavity of the valve body, a product outlet being formed in a valve stem being at least partially supported by the valve body, and at least one radial orifice being formed in the valve stem, adjacent a base portion of the valve stem, to provide communication with the product outlet; and the valve assembly being housed within the pedestal portion and being crimped thereto with a gasket being located between a perimeter sealing surface of the base portion and an adjacent inwardly facing surface of the pedestal portion with a portion of the valve stem supporting the product outlet protruding through an aperture provided in the gasket and the centrally located aperture;

the spray canister being closed at one end and having an opening being defined by a rim at an opposite end thereof;

the perimeter curl of the mounting cup being connected to the rim of the canister to permanently support the valve assembly within the canister; and a spray button, with a discharge orifice, being coupled to the product outlet of the valve stem to facilitate dispensing of the product from the pressurized spray canister;

wherein a top wall of the pedestal portion is conically shaped such that a first plane, defined by the perimeter engagement between the gasket and the base portion of the valve stem, is axially spaced from a second plane, defined by the perimeter engagement between the gasket and a central portion of the valve stem, to provide an axial spacing along the valve stem for accommodating the at least one radial orifice between the first and second planes.

10. The pressurized spray canister according to claim 9, wherein the at least one radial orifice has a diameter of approximately of between 0.013 and 0.030 inches.

11. The pressurized spray canister according to claim 9, wherein the conically shaped top wall of the pedestal portion slopes, relative to a plane defined by the mounting cup, at an angle of about 25 degrees.

12. The pressurized spray canister according to claim 9, wherein a remote portion of the valve body includes a dip tube coupling, having a product inlet formed therein, which supports a first end of a dip tube that facilitates communication of product to be dispensed with the interior cavity of the valve body.

13. The pressurized spray canister according to claim 9, wherein a spring is located within the interior cavity of the valve body and normally biases the base portion of the valve stem into engagement with the gasket to provide a fluid tight seal therebetween and maintain the valve in a normally closed position.

14. The pressurized spray canister according to claim 13, wherein the base portion includes an annular perimeter sealing protrusion which forms the fluid tight seal with the gasket when engaged therewith under the biasing force of the spring.

15. The pressurized spray canister according to claim 9, wherein the base portion includes a nub, on a surface thereof remote from a cylindrical portion of the valve stem, which engages with a spring to bias the base of the valve stem into a normally closed position and prevent the flow of product to be dispensed through the at least one radial orifice and the product outlet.

16. The pressurized spray canister according to claim 9, the sufficient clearance along the valve stem is a distance of between about 0.013 and 0.030 inches.

17. A method of forming an improved mounting cup and valve assembly combination for an aerosol container, the method comprising the steps of:

providing a mounting cup with a perimeter curl, for securing the mounting cup to a desired container, and a central pedestal portion with a centrally located aperture being formed in the pedestal portion;

providing a valve assembly with valve body having a product inlet communicating with an interior cavity of the valve body, and a product outlet being formed in a valve stem being at least partially supported by the valve body, and forming at least one radial orifice in the valve stem, adjacent a base portion of the valve stem, to provide communication with the product outlet; and housing the valve assembly within the pedestal portion and crimping the valve assembly therein with a gasket being located between a perimeter sealing surface of the base portion and an adjacent inwardly facing surface of the pedestal portion with a portion of the valve stem, supporting the product outlet, protruding through an aperture provided in the gasket and the centrally located aperture;

contouring a top wall of the pedestal portion to have a conical shape such that a first plane, defined by the perimeter engagement between the gasket and the base portion of the valve stem, is axially spaced along the valve stem from a second plane, defined by the perimeter engagement between the gasket and a central portion of the valve stem, with the at least one radial orifice being formed in the valve stem at a location between the first plane and the second plane.

18. The method according to claim 17, further comprising the step of forming the at least one radial orifice with a transverse dimension of between 0.013 and 0.030 inches.

19. The method according to claim 17, further comprising the step of sloping the conically shaped top wall of the pedestal portion, relative to a plane defined by the mounting cup, at an angle of about 25 degrees.

20. The method according to claim 17, further comprising the step of forming a dip tube coupling, having a product inlet formed therein, on the valve body, and connecting a first end of a dip tube with the dip tube coupling to facilitate communication between a product to be dispensed and the interior cavity of the valve body.

* * * * *